US007876560B2

(12) United States Patent
Huang

(10) Patent No.: US 7,876,560 B2
(45) Date of Patent: Jan. 25, 2011

(54) ELECTRONIC DEVICE

(75) Inventor: Chiang-Cheng Huang, Taipei (TW)

(73) Assignee: Risun Expanse Corp., Taipei (TW)

( * ) Notice: Subject to any disclaimer, the term of this patent is extended or adjusted under 35 U.S.C. 154(b) by 0 days.

(21) Appl. No.: 12/493,655

(22) Filed: Jun. 29, 2009

(65) Prior Publication Data

US 2010/0328881 A1 Dec. 30, 2010

(51) Int. Cl.
*H05K 7/20* (2006.01)
*F01D 25/28* (2006.01)

(52) U.S. Cl. ..... 361/695; 361/690; 415/213.1

(58) Field of Classification Search ..... None
See application file for complete search history.

(56) References Cited

U.S. PATENT DOCUMENTS 4,700,127 A * 10/1987 Sasaki et al. ..... 324/633
5,297,929 A * 3/1994 Horng ..... 415/121.3
5,421,701 A * 6/1995 Funston ..... 416/5
5,458,505 A * 10/1995 Prager ..... 439/485
6,841,136 B2 * 1/2005 Kwak ..... 422/186.03
7,258,464 B2 * 8/2007 Morris et al. ..... 362/264
7,296,957 B2 * 11/2007 Walter et al. ..... 411/175
7,575,346 B1 * 8/2009 Horng et al. ..... 362/373
2004/0175281 A1 * 9/2004 Remington ..... 417/360
2008/0305015 A1 * 12/2008 Ryu et al. ..... 422/122
2010/0021294 A1 * 1/2010 Yeh ..... 415/213.1

* cited by examiner

*Primary Examiner*—Boris L Chervinsky
(74) *Attorney, Agent, or Firm*—Tim Tingkang Xia; Morris Manning & Martin, LLP

(57) ABSTRACT

An electronic device is directly disposed on a lamp base and is powered by the lamp base. The electronic device includes a connection base matching with a specification of the lamp base, and an air-flow generator. The connection base may be directly screwed into the lamp base to power the air-flow generator, so that the air-flow generator operates to generate an air flow.

14 Claims, 8 Drawing Sheets

ELECTRONIC DEVICE

BACKGROUND OF THE INVENTION

1. Field of the Invention

The present invention relates to an electronic device, and more particularly to an air-flow generating device directly disposed on a lamp base.

2. Related Art

Nowadays, the concept of design is attracting more and more attention. As the household income gradually increases, people start to pay more attention to the household decoration and furnishing. "Illumination" is the most important element in the decorative design, and specifically, more than one set of lighting devices is disposed in almost every corner of a house including a living room, a dining room, a bedroom, and a washroom.

Indoor wiring for lamp bases is preplanned when the house is built, and positions for disposing the lamp bases cannot be easily changed at any time, so that the subsequent decoration and furnishing operations are mostly carried out to cater to the positions of the lamp bases, and meanwhile, the furnishing of the overall space is further considered. If a resident changes positions of furniture or even rearranges the usage of the indoor space at will according to his/her preferences, the preset lamp bases may not be suitable for the decoration and furnishing changed by the resident at will. As a result, a part of the lamp bases cannot achieve an optimal illumination effect.

A conventional lamp base for indoor use has a cup-shaped electrical connection base. The electrical connection base has an internal thread. A conventional bulb has a light-emitting body and a terminal portion. An external thread fitting with the internal thread of the electrical connection base is configured on an outer edge of the terminal portion, such that the terminal portion of the bulb can be directly screwed into the lamp base, so that a user can easily replace the bulb.

Currently, environmental awareness and energy conservation concepts have become hot topics and directions for research and development all over the world, and the consciousness of environmental protection and energy conservation has deeply rooted in people's daily life. Considering the selection of bulbs, traditional bulbs have been gradually abandoned, and instead, power-saving bulbs that consume less power are used, so as to achieve the energy conservation effects. In the year of 1997, many countries signed "Kyoto Protocol" in Kyoto, Japan, in which the countries agreed to jointly reduce the carbon emission (i.e., emission of carbon dioxide) and alleviate the severe influence caused by the greenhouse effect on the global climate.

In addition, if an indoor light device lost its original illumination effect due to the changing of the indoor furnishing, the resident is most likely to detach the bulb. In this way, the electrical energy is saved and unnecessary energy waste is avoided, and meanwhile, carbon dioxide produced when the bulb emits lights is further reduced.

However, after the bulb is detached from the lighting device, only a lamp base embedded in the wall is left, and the lamp base substantially has no function if it is not electrically connected to a bulb, which is a waste of both cost and resources.

Furthermore, as most people get used to using air conditioners or fans, and the global temperatures have been increasing in recent years, the ordinary household power consumption greatly increases due to the long-time usage of air conditioners or fans, which in turn exacerbates the global warming. As an air conditioner or fan mostly blows air in a specific direction and cannot blow air towards every corner of a house due to the restrictions of the arranged position thereof, the operating performance of the air conditioner or fan must be improved if a large-scale indoor air circulation is required. As a result, more power will be consumed, which does not conform to the environmental protection and energy conservation concepts that are currently advocated.

Therefore, it has become an issue that has been thought about by the applicant for a long time how to effectively utilize the lamp base that is not disposed with a bulb to derive new functions of the lamp base except the illumination function, for example, a function of generating an air flow for indoor air circulation, and meanwhile avoiding problems of infinite waste of global resources, rapid energy exhaustion, and rapid global warming.

SUMMARY OF THE INVENTION

Accordingly, the present invention is an electronic device, which can solve the problem in the prior art that a lamp base that is not disposed with a bulb cannot achieve its function, and result in a waste of manufacturing resources.

An electronic device is provided in the present invention, which is disposed on a lamp base, and comprises a connection base and an air-flow generator. The connection base has a threaded connecting portion on one side thereof, and the threaded connecting portion is connected to the lamp base. The air-flow generator is disposed on the connection base and used for generating an air flow.

The efficacy of the present invention lies in that, a lamp base that is not disposed with a bulb is changed to be electrically connected to a connection base provided with an air-flow generator for generating a air flow, so as to improve the indoor air circulation. Thus, a desirable ventilation effect is achieved in the entire environment, which is beneficial to the human health.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1A:
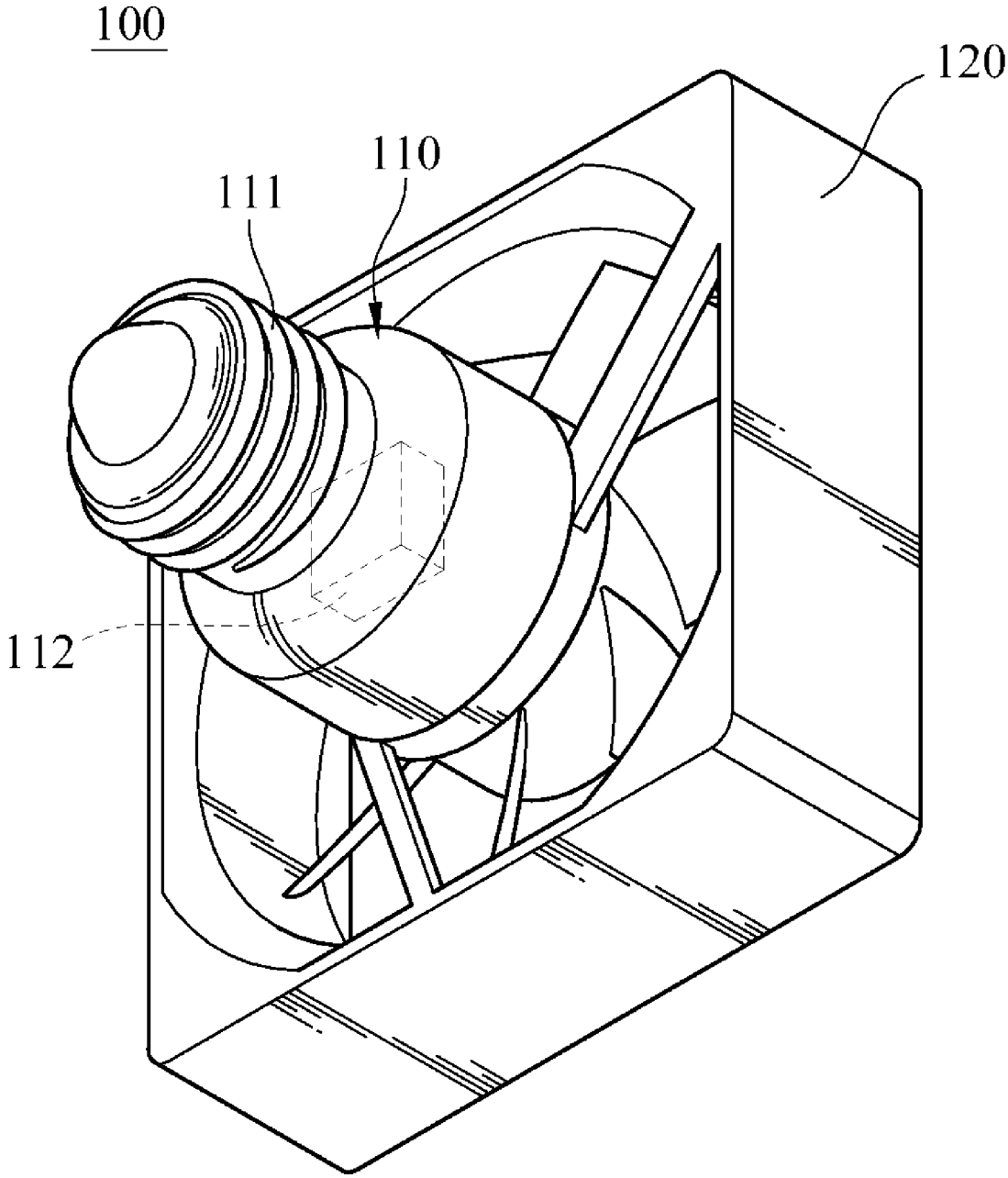
FIG. 1A is a schematic view of a first embodiment of the present invention.
Figure 1B:
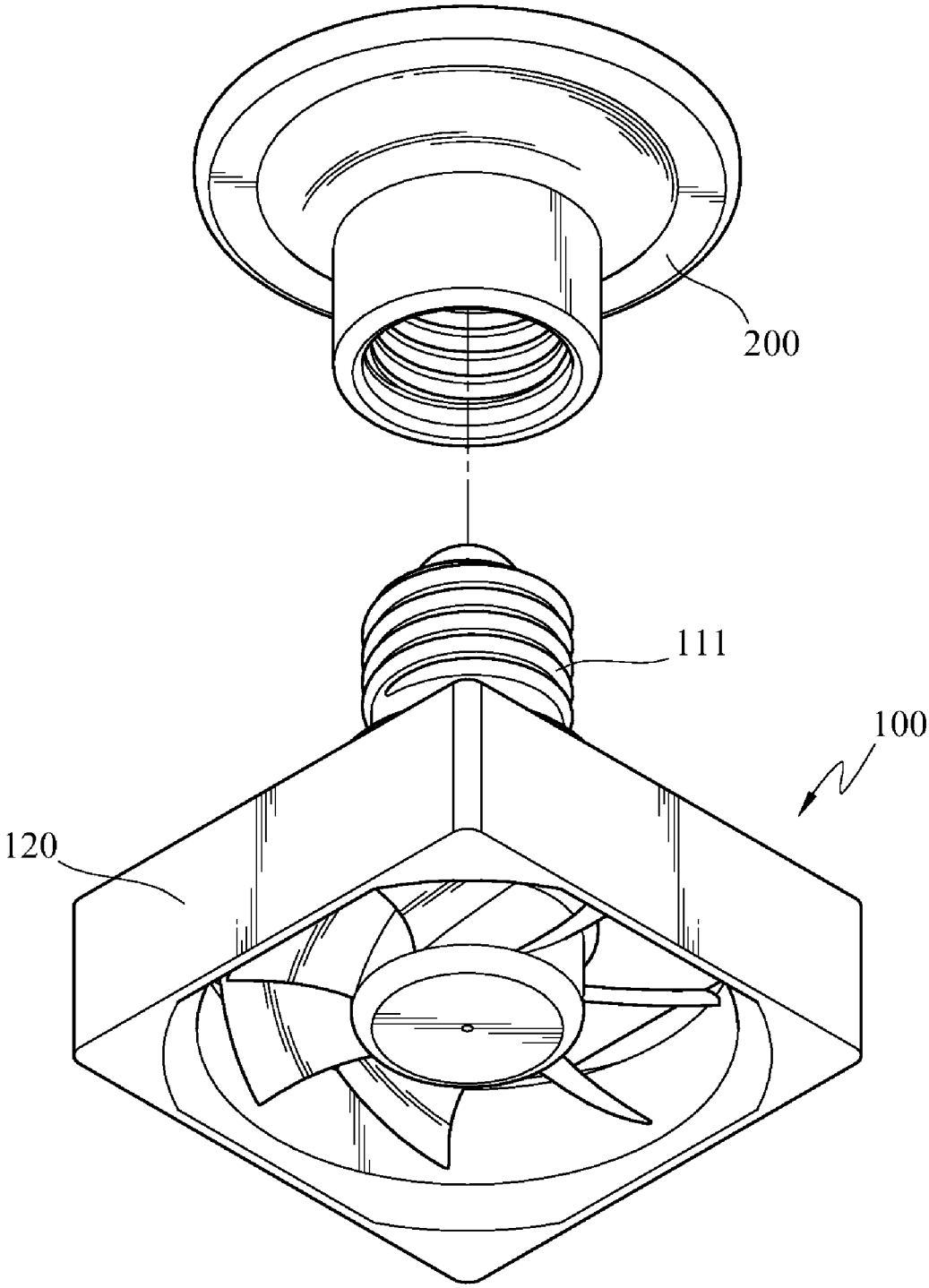
FIG. 1B is a schematic view of the first embodiment of the present invention when being disposed on a lamp base.

FIGS. 1A and 1B are schematic views of a first embodiment of the present invention. In this embodiment, an electronic device 100 disclosed in the present invention is disposed on an alternating current (AC) lamp base 200. The AC lamp base 200 is a commonly used lamp base that matches with power-saving bulbs and has a spiral cup-shaped base therein.

The electronic device 100 comprises a connection base 110 and an air-flow generator 120. The connection base 110 has a threaded connecting portion 111 on one side thereof, and a rectifier 112 is electrically disposed within the connection base 110. The threaded connecting portion 111 has a male thread, and the lamp base 200 has a female thread matching with the male thread therein. The threaded connecting portion 111 may adopt standard lamp-cap specifications of commonly used screw-type bulbs, for example, E11, E17, E27, and other various household specifications (E means that the threaded connecting portion 111 is a screw-type connecting portion, and 11, 17, and 27 are diameters of the threaded connecting portion 111), and match with the female thread of the lamp base 200. The male thread is fitted with the female thread, such that the threaded connecting portion 111 is electrically connected to the AC lamp base 200. At this time, the rectifier 112 receives an AC power supplied by the lamp base 200, converts the AC power into a direct current (DC) power, and then outputs the DC power.

Figure 2:
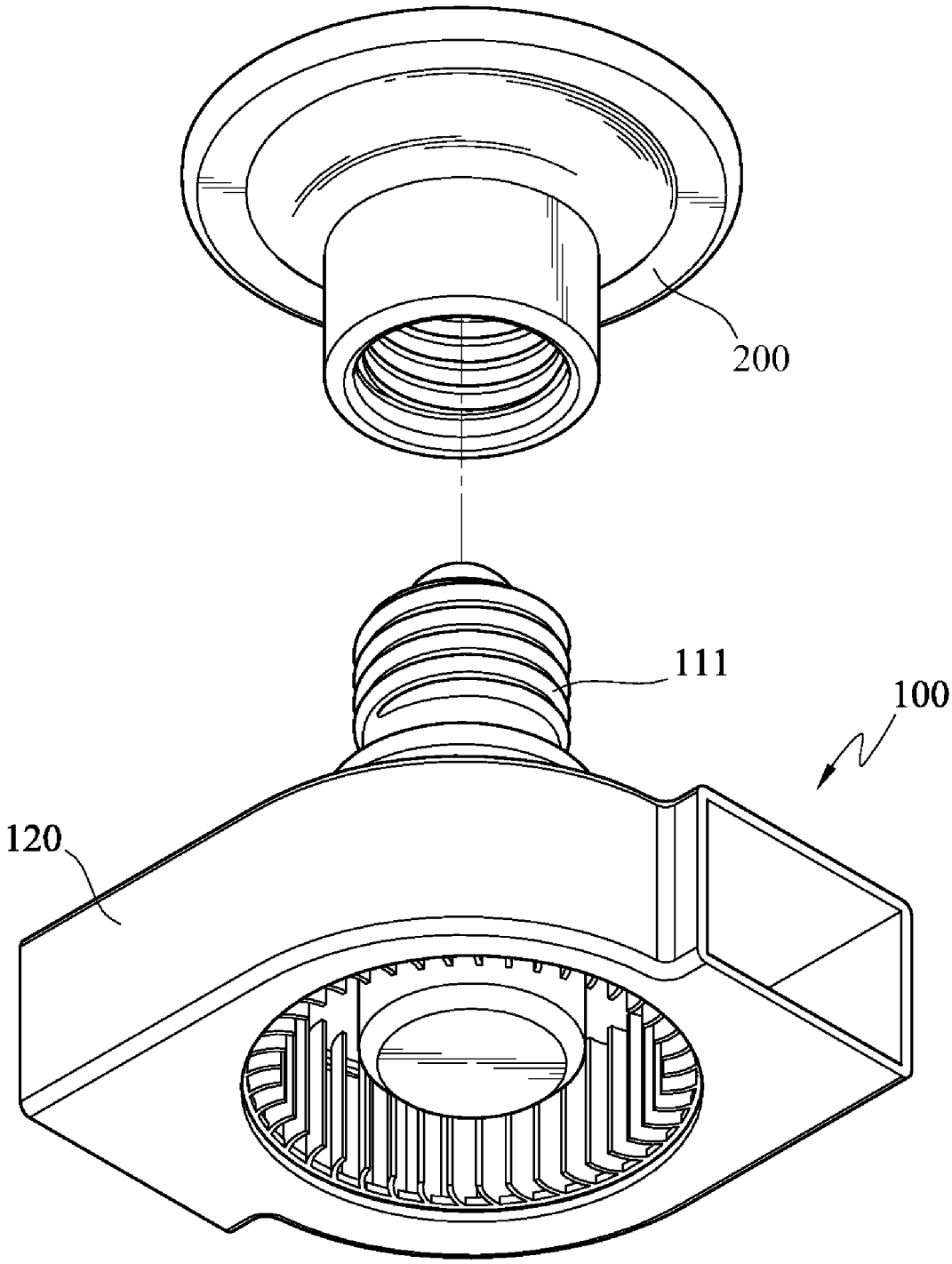
FIG. 2 is a schematic view of a second embodiment of the present invention.

The air-flow generator 120 is an axial-flow fan, and is disposed on the other side of the connection base 110 opposite to the threaded connecting portion 111. The air-flow generator 120 is electrically connected to the rectifier 112 to receive the DC power output by the rectifier 112 and generate an air flow, so as to generate air turbulence around the electronic device 100. In addition, as shown in FIG. 2, the air-flow generator 120 disclosed in the present invention may also be selected as a centrifugal fan according to the practical usage requirements, and the centrifugal fan has two vents, so as to achieve different air turbulence effects around the electronic device 100. However, it should be understood by those skilled in the art that, the centrifugal fan may also be designed to have more than three vents, so as to achieve an air turbulence effect required in an actual environment.

In addition to a rectangular structure as shown in FIGS. 1 and 2, a housing of the air-flow generator 120 may also be designed as circular, elliptical, triangular, square, hexagonal, octagonal, and other geometric structures, so as to match with the indoor decoration and beautify the indoor space, but it is not limited to the geometric shapes disclosed in this embodiment.

Figure 3:
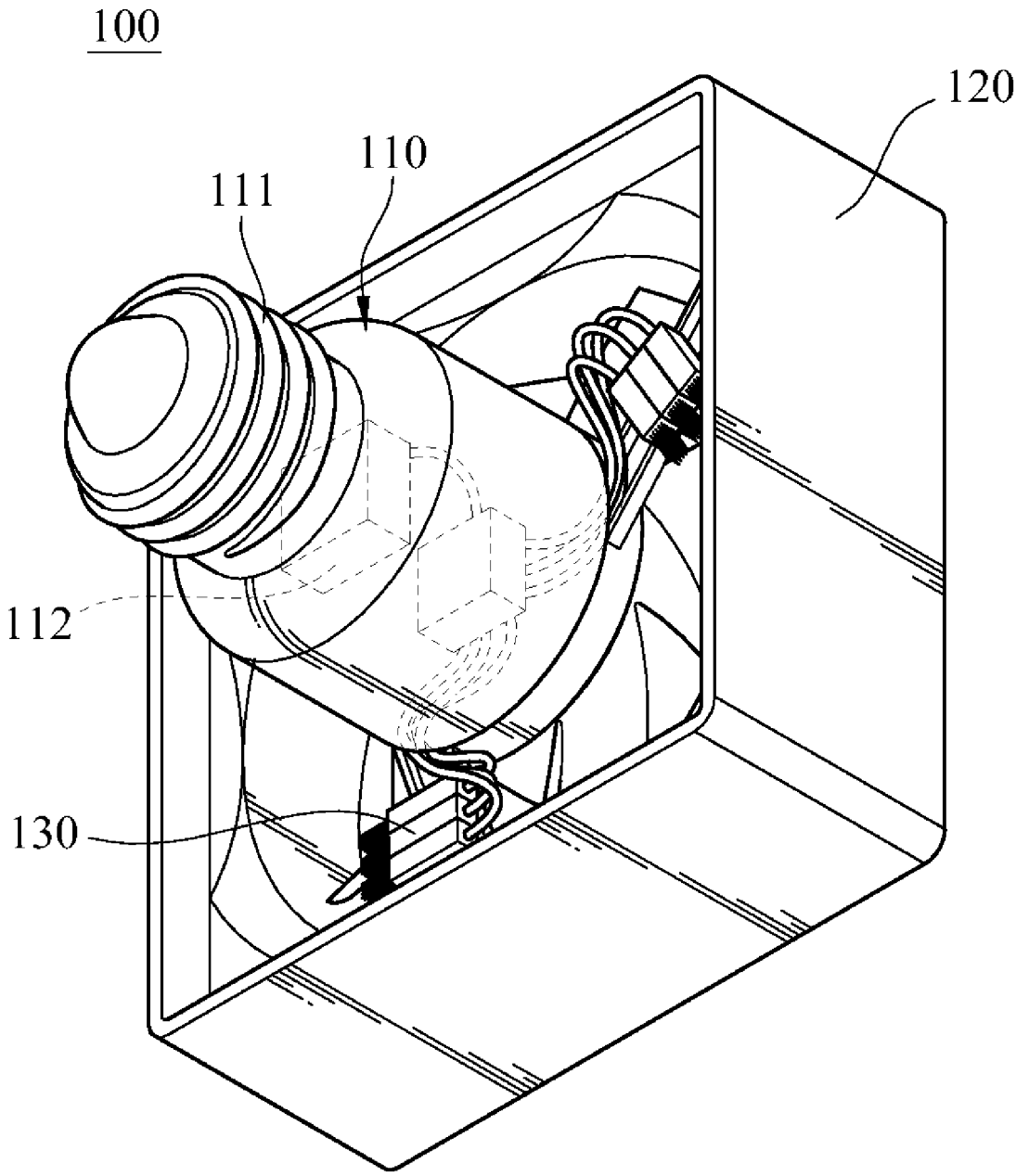
FIG. 3 is a schematic view of a third embodiment of the present invention.
Figure 4:
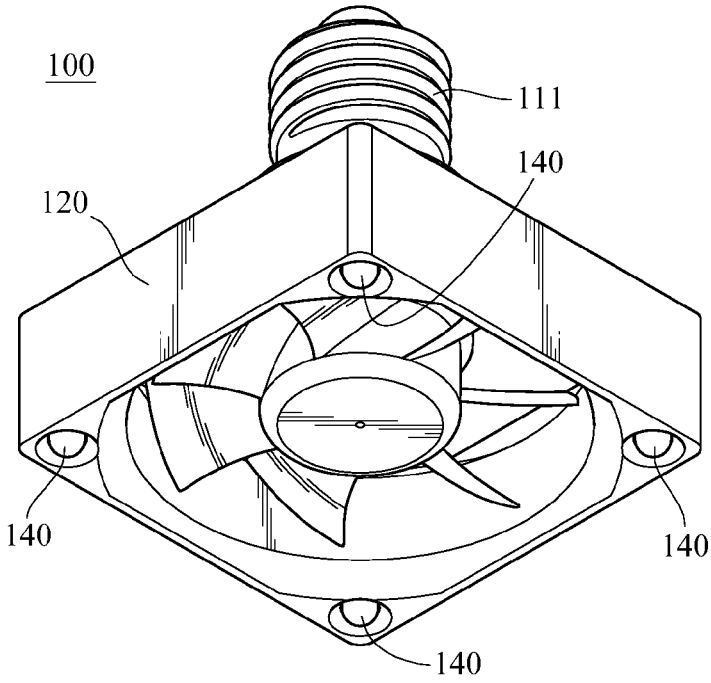
FIG. 4 is a schematic view of a fourth embodiment of the present invention.

Referring to FIG. 3, an anion generator 130 may be further disposed at an air inlet of the air-flow generator 120. The anion generator 130 is electrically connected to the rectifier 112, so as to receive the DC power and release anions. The anions are dispersed outwards by the air flow generated by the air-flow generator 120 to purify the air in the surrounding environment. Referring to FIG. 4, the electronic device 100 of the present invention may further comprise at least one light emitting diode (LED) 140 disposed on an outer side of the air-flow generator 120, and the LED 140 is electrically connected to the rectifier 112 to receive the DC power and generate light rays.

Figure 5A:
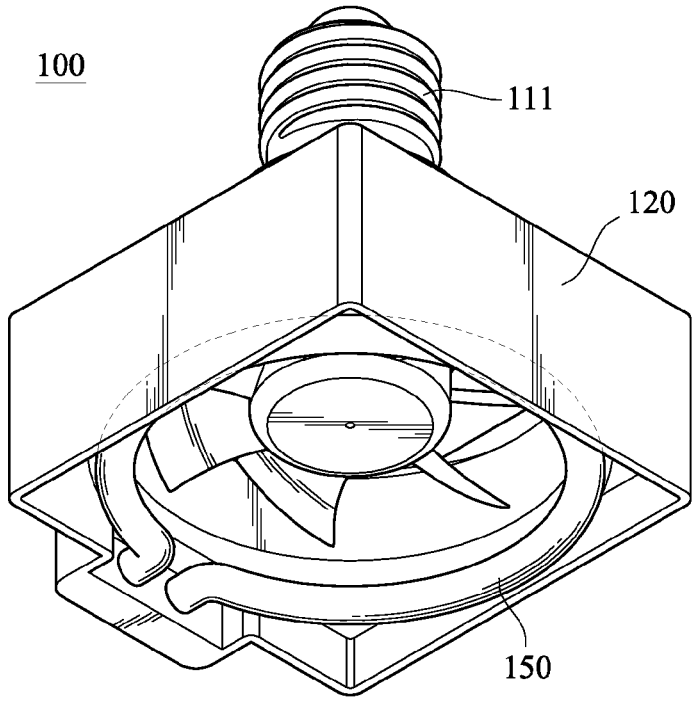
FIG. 5A is a schematic view of a fifth embodiment of the present invention.
Figure 5B:
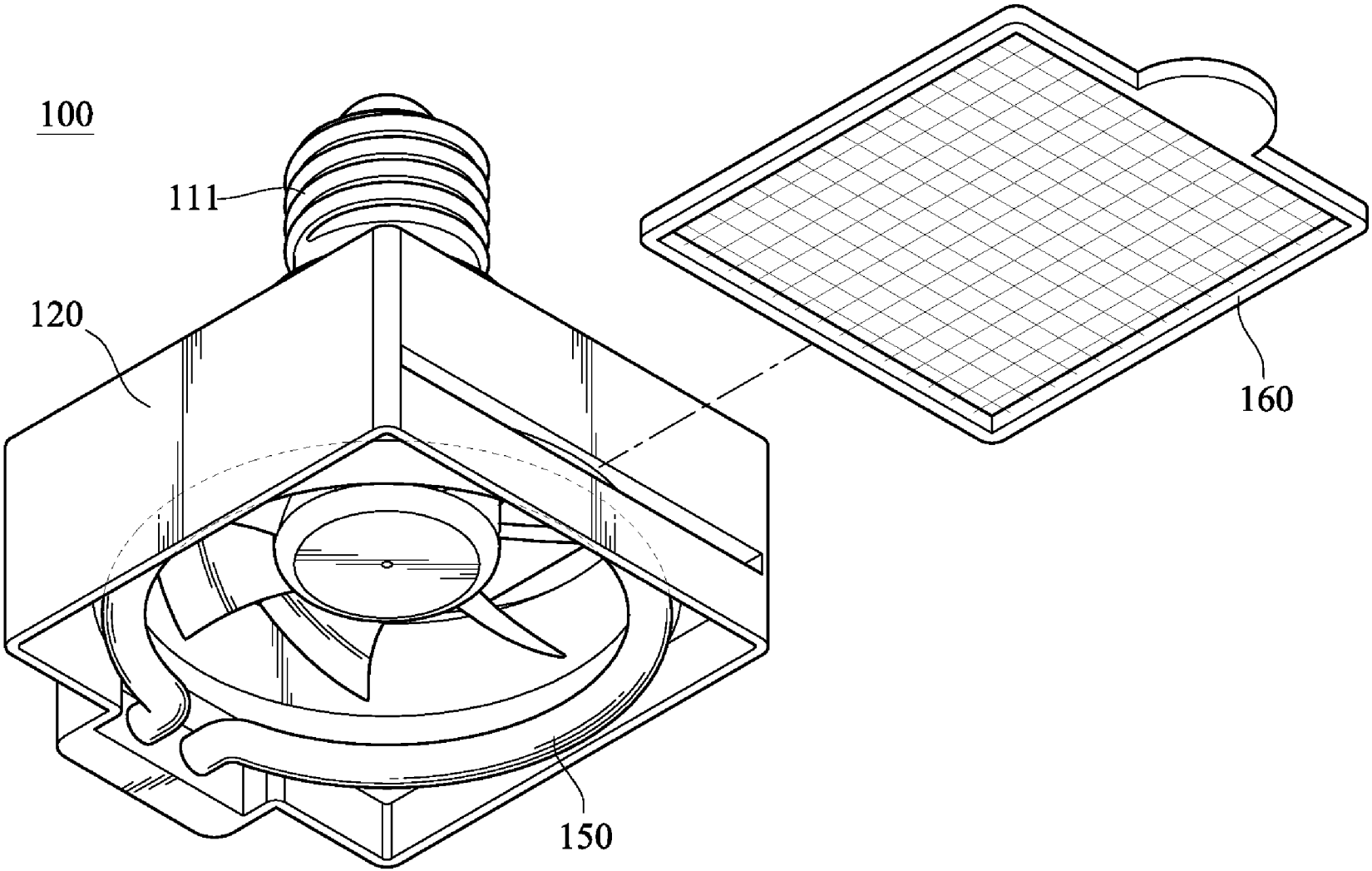
FIG. 5B is a schematic view of a sixth embodiment of the present invention.

As shown in FIG. 5A, in the present invention, an ultraviolet lamp 150 may also be disposed on the outer side of the air-flow generator 120. The ultraviolet lamp 150 is electrically connected to the rectifier 112 to receive the DC power and generate ultraviolet rays for disinfecting the surrounding environment of the electronic device 100. Referring to FIG. 5B, a photocatalyst screen 160 corresponding to the ultraviolet lamp 150 may be further disposed at an air outlet of the air-flow generator 120. When the ultraviolet lamp 150 emits ultraviolet rays for disinfection, the photocatalyst screen 160 receives the ultraviolet rays and a photocatalyst reaction occurs, and thus the ozone disinfection is carried out in the surrounding environment through the air flow generated by the air-flow generator 120. Through the cooperation of the ultraviolet lamp 150 and the photocatalyst screen 160, the environmental cleaning and disinfection effects are improved.

Figure 6:
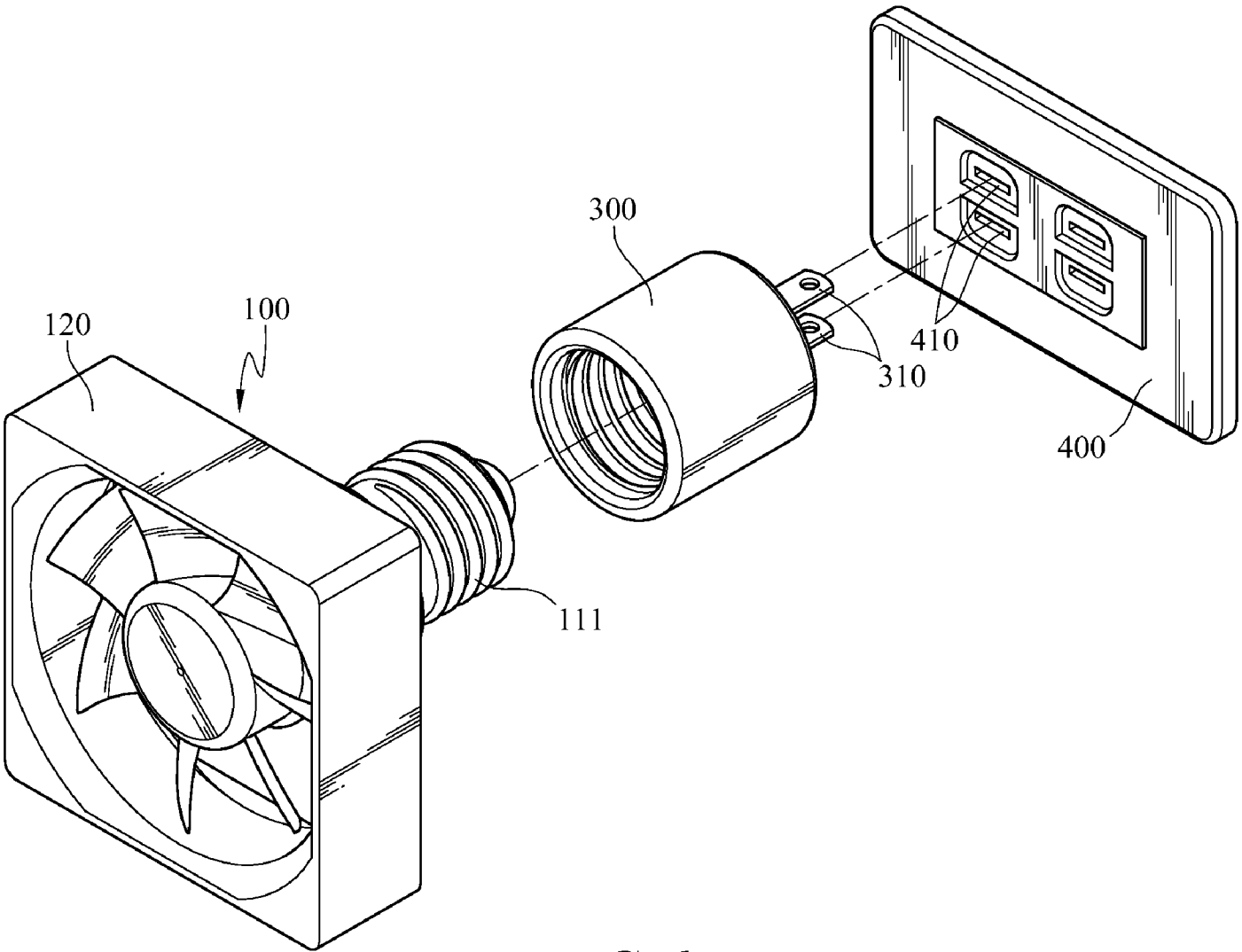
FIG. 6 is a schematic view of a seventh embodiment of the present invention.

Referring to FIG. 6, the electronic device 100 of the present invention may also be disposed on an electrical socket 400 commonly used in ordinary households. In this embodiment, the threaded connecting portion 111 of the connection base 110 is electrically connected to an adapter 300. The threaded connecting portion 111 has a male thread of standard lamp-cap specifications, and the male thread matches with and is fitted with a female thread within the adapter 300. Two conductive terminals 310 are provided on the other side of the adapter 300 opposite to the threaded connecting portion 111, and the two conductive terminals 310 are inserted into two jacks 410 of the electrical socket 400 to receive an AC power provided by the electrical socket 400. At this time, the rectifier 112 in the connection base 110 converts the AC power into a DC power and outputs the DC power to the air-flow generator 120, so as to enable the air-flow generator 120 to generate an air flow.

Figure 7:
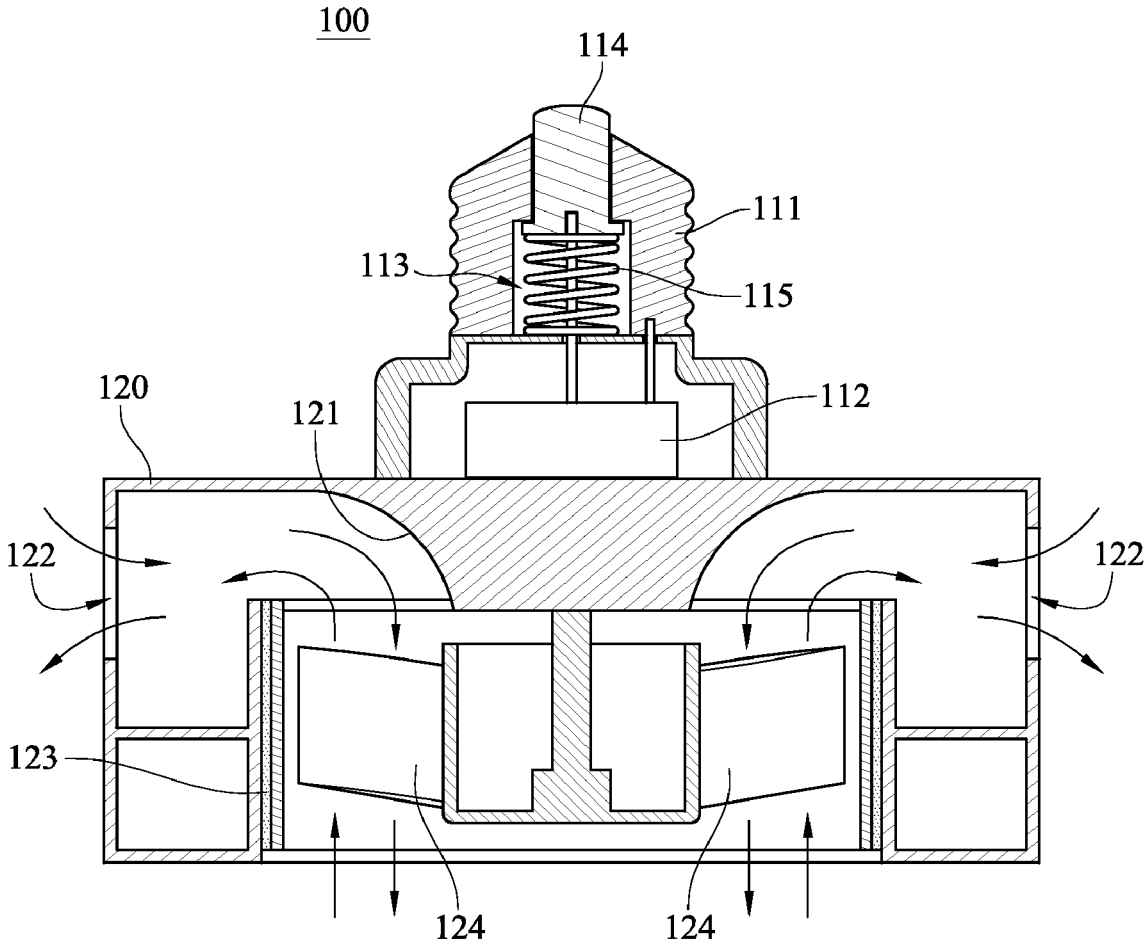
FIG. 7 is a cross-sectional view of an eighth embodiment of the present invention.

Referring to FIG. 7, as for the electronic device 100 in an eighth embodiment of the present invention, the threaded connecting portion 111 has an accommodation space 113 therein, and a through hole in communication with the accommodation space 113 is formed on the other side of the threaded connecting portion 111 opposite to the air-flow generator 120. The threaded connecting portion 111 further comprises an electrical connection post 114 and an elastic element 115. The electrical connection post 114 is inserted in the through hole, and is electrically connected to a lamp base (not shown). The elastic element 115 is disposed in the accommodation space 113 and is connected to a bottom end of the electrical connection post 114, so as to elastically press against the electrical connection post 114 to protrude out of the threaded connecting portion 111.

The electrical connection post 114 of the present invention may be moved reciprocatingly in the through hole through the elastic element 115, which significantly improves the electrical connection between the electrical connection post 114 and the lamp base and enables the electronic device 100 to stably receive a current. As such, no short circuit or spark occurs at the electrical connection post 114, thus increasing the safety of the electronic device 100 in use.

The elastic element 115 in the eighth embodiment of the present invention is a compression spring. However, it should be understood by those skilled in the art that, any elastic material that can be elastically deformed and generate a restoring force may be selected such as a washer, but the present invention is not limited here.

Referring to FIG. 7, the air-flow generator 120 further comprises a flow guide portion 121 therein, and at least one vent 122 corresponding to the flow guide portion 121 is opened on a side wall of the air-flow generator 120. One side of the flow guide portion 121 facing the fan blades 124 is a camber for guiding the air flow towards the vent 122, so as to generate air turbulence around the electronic device 100. A filter material may be additionally provided at the vent 122 to purify the air in the surrounding environment.

The air-flow generator 120 further comprises at least one damping washer 123 disposed adjacent to the fan blades 124, so as to absorb the vibration energy produced when the fan blades 124 rotate and the shear energy produced when the air flow is guided to the flow guide portion 121, thereby reducing the noises generated during the operation of the air-flow generator 120.

The electronic device of the present invention is electrically connected to a lamp base, so as to effectively utilize the unused lamp base, thereby avoiding unnecessary waste of resources, and satisfying carbon reduction requirements specified in "Kyoto Protocol". Meanwhile, the air flow generated by the air-flow generator may cause the indoor air to flow, so as to improve the air ventilation in the entire environment.

The electronic device of the present invention may be additionally equipped with an anion generator, an ultraviolet lamp, a photocatalyst screen, as well as other components, so as to disinfect the living environment through the air flow generated by the air-flow generator, which is beneficial to the human health.

What is claimed is:

1. An electronic device, disposed on a lamp base, the electronic device comprising:

a connection base, having a threaded connecting portion connected to the lamp base; and an air-flow generator, disposed on the connection base, for generating an air flow, wherein the threaded connecting portion has an accommodation space therein, the threaded connecting portion is formed with a through hole on one side thereof, an electrical connection post and an elastic element are disposed in the accommodation space, the electrical connection post is inserted in the through hole, and the elastic element is connected to one end of the electrical connection post, so as to force the electrical connection post to protrude out of the threaded connecting portion.

2. The electronic device according to claim 1, wherein the threaded connecting portion has a male thread, the lamp base has a female thread matching with the male thread therein, and the male thread is fitted with the female thread, such that the threaded connecting portion is connected to the lamp base.

3. The electronic device according to claim 1, wherein the air-flow generator is an axial-flow fan or a centrifugal fan.

4. The electronic device according to claim 1, wherein the air-flow generator further comprises a flow guide portion therein, and at least one vent corresponding to the flow guide portion is disposed on a side wall of the air-flow generator.

5. The electronic device according to claim 1, wherein the air-flow generator further comprises at least one damping washer therein.

6. An electronic device, disposed on an alternating current (AC) lamp base and used for generating an air flow, the electronic device comprising:

a connection base, having a threaded connecting portion and a rectifier, wherein the threaded connecting portion is connected to the AC lamp base, and the rectifier outputs a direct current (DC) power; and an air-flow generator, disposed on the connection base and electrically connected to the rectifier, wherein the air-flow generator receives the DC power and generates an air flow, wherein the threaded connecting portion has an accommodation space therein, the threaded connecting portion is formed with a through hole on one side thereof, an electrical connection post and an elastic element are disposed in the accommodation space, the electrical connection post is inserted in the through hole, and the elastic element is connected to one end of the electrical connection post, so as to force the electrical connection post to protrude out of the threaded connecting portion.

7. The electronic device according to claim 6, further comprising an anion generator disposed in the air-flow generator, wherein the anion generator is electrically connected to the rectifier to release a plurality of anions.

8. The electronic device according to claim 6, further comprising at least one light emitting diode (LED) disposed on the air-flow generator, wherein the LED is electrically connected to the rectifier to receive the DC power.

9. The electronic device according to claim 6, further comprising an ultraviolet lamp disposed on the air-flow generator, wherein the ultraviolet lamp is electrically connected to the rectifier to receive the DC power.

10. The electronic device according to claim 9, wherein the air-flow generator further comprises a photocatalyst screen and the photocatalyst screen is disposed opposite to a flowing direction of the air flow and corresponding to the ultraviolet lamp.

11. The electronic device according to claim 6, wherein the threaded connecting portion has a male thread, the AC lamp base has a female thread matching with the male thread therein, and the male thread is fitted with the female thread, such that the threaded connecting portion is connected to the AC lamp base.

12. The electronic device according to claim 6, wherein the air-flow generator is an axial-flow fan or a centrifugal fan.

13. The electronic device according to claim 6, wherein the air-flow generator further comprises a flow guide portion therein, and at least one vent corresponding to the flow guide portion is disposed on a side wall of the air-flow generator.

14. The electronic device according to claim 6, wherein the air-flow generator further comprises at least one damping washer therein.

* * * * *